US010808492B2

(12) United States Patent
Hern et al.

(10) Patent No.: US 10,808,492 B2
(45) Date of Patent: Oct. 20, 2020

(54) FRAC PLUG SYSTEM HAVING AN INTEGRATED SETTING TOOL

(71) Applicants: Gregory Hern, Porter, TX (US); Kent Meyer, Tomball, TX (US)

(72) Inventors: Gregory Hern, Porter, TX (US); Kent Meyer, Tomball, TX (US)

(73) Assignee: BAKER HUGHES, A GE COMPANY LLC, Houston, TX (US)

( * ) Notice: Subject to any disclaimer, the term of this patent is extended or adjusted under 35 U.S.C. 154(b) by 26 days.

(21) Appl. No.: 16/195,263

(22) Filed: Nov. 19, 2018

(65) Prior Publication Data

US 2020/0157915 A1 May 21, 2020

(51) Int. Cl.

| | |
|---|---|
| ***E21B 33/128*** | (2006.01) |
| ***E21B 33/129*** | (2006.01) |
| ***E21B 23/04*** | (2006.01) |
| ***E21B 23/01*** | (2006.01) |
| ***E21B 23/06*** | (2006.01) |
| *E21B 43/26* | (2006.01) |
| *E21B 33/1295* | (2006.01) |

(52) U.S. Cl.

CPC ..... *E21B 33/1285* (2013.01); *E21B 23/01* (2013.01); *E21B 23/04* (2013.01); *E21B 23/065* (2013.01); *E21B 33/129* (2013.01); *E21B 23/0414* (2020.05); *E21B 33/12955* (2013.01); *E21B 43/26* (2013.01); *E21B 2200/08* (2020.05)

(58) Field of Classification Search

CPC ..... E21B 33/1285; E21B 23/01; E21B 23/04; E21B 33/129; E21B 23/065; E21B 33/12; E21B 33/128; E21B 43/26; E21B 43/16; E21B 33/134

See application file for complete search history.

(56) References Cited

U.S. PATENT DOCUMENTS

| | | | |
|---|---|---|---|
| 2,707,998 | A | 5/1955 | Baker et al. |
| 2,807,325 | A | 9/1957 | Webb |
| 3,024,843 | A | 3/1962 | Dean |

(Continued)

OTHER PUBLICATIONS

International Search Report and Written Opinion for Intnerional Application No. PCT/US2019/061806; International Filing Date Nov. 15, 2019; Report dated Mar. 11, 2020 (pp. 1-10).

(Continued)

*Primary Examiner* — D. Andrews
*Assistant Examiner* — Manuel C Portocarrero
(74) *Attorney, Agent, or Firm* — Cantor Colburn LLP

(57) ABSTRACT

A downhole tool has a setting cone including a body having an outer surface having a first end, a second end. At least a portion of the body includes a taper at the second end. A passage extends through the body. The passage includes a first portion having a first diameter and a second portion having a second diameter that is less than the first diameter. An anchor is arranged at the second end of the setting cone. The anchor includes a central passage that aligns with the passage through the setting cone. A mandrel extends through the passage of the setting cone and the central passage of the anchor. The mandrel includes a first end portion, a second end portion and an intermediate section. A conduit extends from the first end portion toward the second end portion. A portion of the conduit defines an actuation chamber.

26 Claims, 6 Drawing Sheets

(56) References Cited

U.S. PATENT DOCUMENTS

| | | | | |
|---|---|---|---|---|
| 3,977,473 | A | 8/1976 | Page | |
| 5,024,270 | A | 6/1991 | Bostick | |
| 7,017,672 | B2 | 3/2006 | Owen, Sr. et al. | |
| 9,528,342 | B2 * | 12/2016 | Xu | E21B 33/1293 |
| 9,810,035 | B1 | 11/2017 | Carr et al. | |
| 10,443,331 | B1 * | 10/2019 | Andres | E21B 23/065 |
| 2004/0216868 | A1 | 11/2004 | Owen, Sr. | |
| 2005/0230100 | A1 | 10/2005 | Hirth et al. | |
| 2010/0230116 | A1 | 9/2010 | Harmon et al. | |
| 2013/0186649 | A1 | 7/2013 | Xu et al. | |
| 2014/0041857 | A1 | 2/2014 | Xu et al. | |
| 2014/0190685 | A1 * | 7/2014 | Frazier | E21B 43/11 166/250.01 |
| 2015/0129203 | A1 * | 5/2015 | Deutch | E21B 43/11 166/250.1 |
| 2016/0290093 | A1 | 10/2016 | Doane et al. | |
| 2018/0016859 | A1 | 1/2018 | Stair et al. | |
| 2018/0051532 | A1 | 2/2018 | Smith et al. | |
| 2020/0157900 | A1 | 5/2020 | Hern et al. | |
| 2020/0157913 | A1 | 5/2020 | Hern et al. | |

OTHER PUBLICATIONS

International Search Report and Written Opinion for Intnerional Application No. PCT/US2019/061911; International Filing Date Nov. 18, 2019; Report dated Mar. 12, 2020 (pp. 1-11).

International Search Report and Written Opinion for Intnerional Application No. PCT/US2019/061914; International Filing Date Nov. 18, 2019; Report dated Mar. 16, 2020 (pp. 1-11).

* cited by examiner

FRAC PLUG SYSTEM HAVING AN INTEGRATED SETTING TOOL

BACKGROUND

In the resource exploration and recovery industry, boreholes are formed to test for and recover formation fluids. During testing and extraction, various tools are deployed into the borehole. A frac plug may be set against a casing and used as part of a process that initiates a fracture in a formation. Setting a frac plug, or other seal may require the use of drop balls, explosive charges or other tools that increase an overall cost and complexity of operation.

Typically, a force, initiated by the explosive charge, may urge a setting member into a seal. After the frac plug is set, guns are fired to perforate the casing. Pressure may then be applied to a drop ball after the tool is removed to fracture the formation. Plugging and perforating the casing and fracturing the formation includes multiple steps. Accordingly, the art would be receptive of alternative methods for setting seals downhole.

SUMMARY

Disclosed is a downhole tool having a setting cone including a body having an outer surface having a first end, a second end and an intermediate portion. At least a portion of the body includes a taper at the second end. A passage extends through the body from the first end to the second end. The passage includes a first portion having a first diameter and a second portion having a second diameter that is less than the first diameter. An anchor is arranged at the second end of the setting cone. The anchor includes a central passage that aligns with the passage through the setting cone. A mandrel extends through the passage of the setting cone and the central passage of the anchor. The mandrel includes a first end portion, a second end portion and an intermediate section. A conduit extends from the first end portion toward the second end portion. A portion of the conduit defines an actuation chamber. An opening extends through the mandrel.

Also disclosed is a resource exploration and recovery system including a first system, and a second system operatively connected to the first system through a wireline. The wireline supports a downhole tool including a setting cone including a body having an outer surface having a first end, a second end and an intermediate portion. At least a portion of the body includes a taper at the second end. A passage extends through the body from the first end to the second end. The passage includes a first portion having a first diameter and a second portion having a second diameter that is less than the first diameter. An anchor is arranged at the second end of the setting cone. The anchor includes a central passage that aligns with the passage through the setting cone. A mandrel extends through the passage of the setting cone and the central passage of the anchor. The mandrel includes a first end portion, a second end portion and an intermediate section. A conduit extends from the first end portion toward the second end portion. A portion of the conduit defines an actuation chamber. An opening extends through the mandrel.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
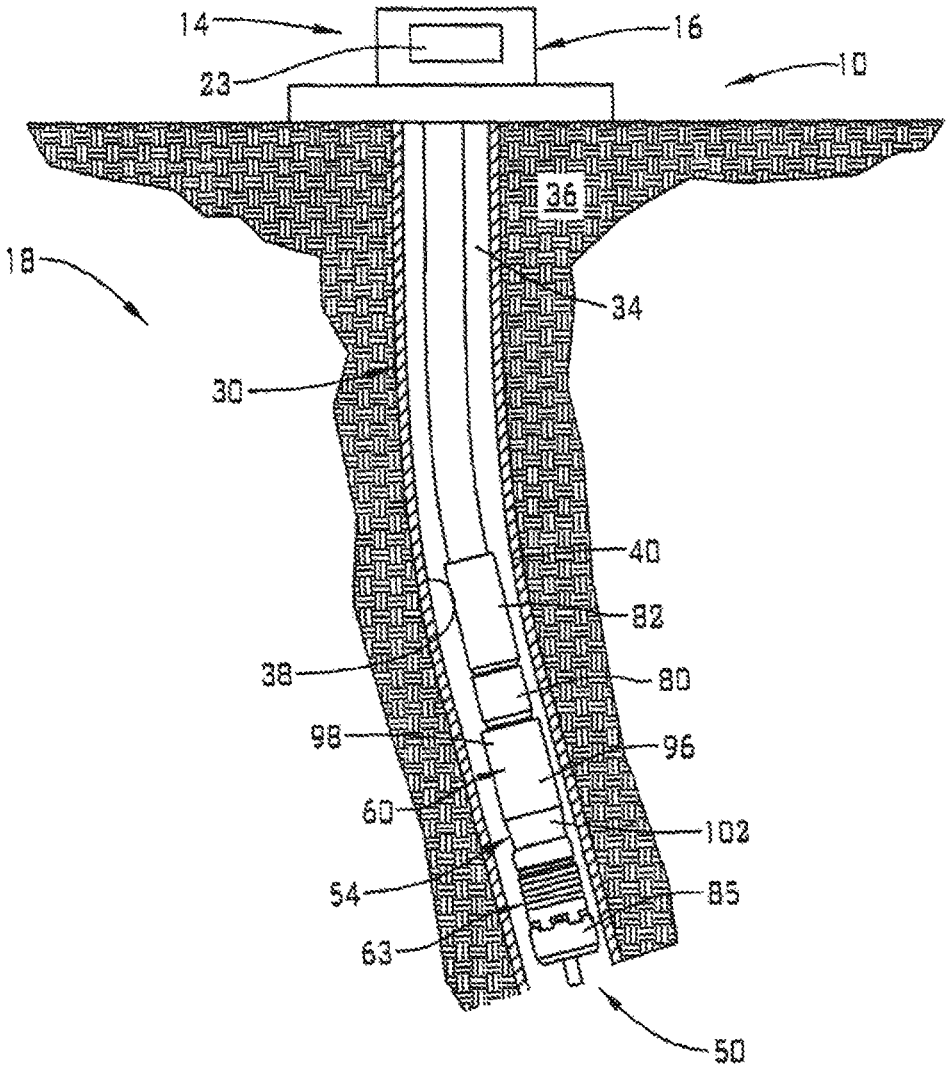
FIG. 1 depicts a resource exploration and recovery system including a frac plug system having an integrated setting tool, in accordance with an aspect of an exemplary embodiment.

A resource exploration and recovery system, in accordance with an exemplary embodiment, is indicated generally at 10, in FIG. 1. Resource exploration and recovery system 10 should be understood to include well drilling operations, completions, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a subterranean system.

First system 14 may include a control system 23 that may provide power to, monitor, communicate with, and/or activate one or more downhole operations as will be discussed herein. Surface system 16 may include additional systems such as pumps, fluid storage systems, cranes and the like (not shown). Second system 18 may include tubular string or wireline 30 that extends into a wellbore 34 formed in formation 36. Wireline 30 may be operatively connected to control system 23. Wellbore 34 includes an annular wall 38 which may be defined by a surface of formation 36, or a casing tubular 40 such as shown.

Figure 2:
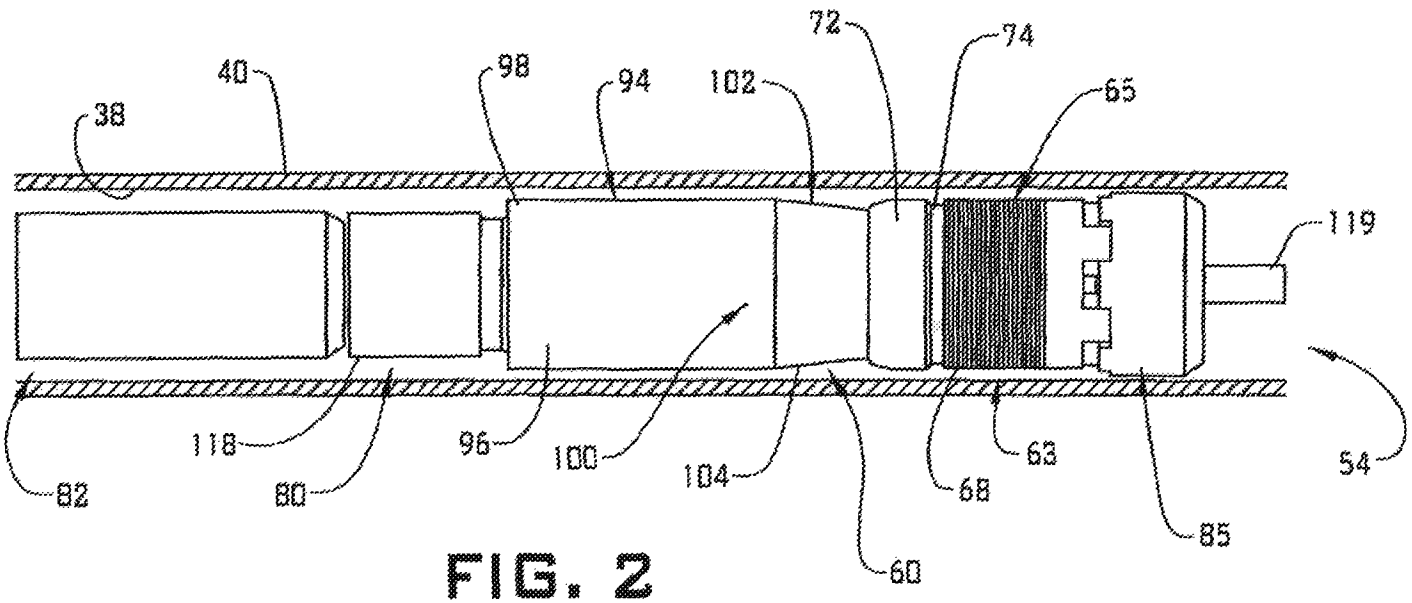
FIG. 2 depicts the frag plug system of FIG. 1, in accordance with an aspect of an exemplary embodiment.

In an exemplary aspect, wireline 30 supports a downhole tool 50. As will be detailed herein, downhole tool 50 may take the form of a frac plug system 54 that may be selectively engaged with annular wall 38. Referring to FIG. 2 frac plug system 54 includes a setting cone 60 that may force an anchor 63 into engagement with annular wall 38. Anchor 63 may take the form of a slip 65 having a plurality of wickers 68. Wickers 68 "bite" into annular surface 38 when slip 65 moves along setting cone 60. Setting cone 60 also supports a seal 72 and a backup ring 74. Backup ring 74 urges seal 72 along setting cone 60. Seal 72 may seal against annular wall 38.

A mandrel 80 extends through setting cone 60 and supports an actuator head 82. Mandrel 80 also extends through an end cap 85. As will be detailed herein, actuator head 82 establishes a force that drives mandrel 80 axially relative to setting cone 60. End cap 85 drives slip 65 along setting cone 60 forcing wickers 68 and seal 72 into contact with annular wall 38.

Figure 3:
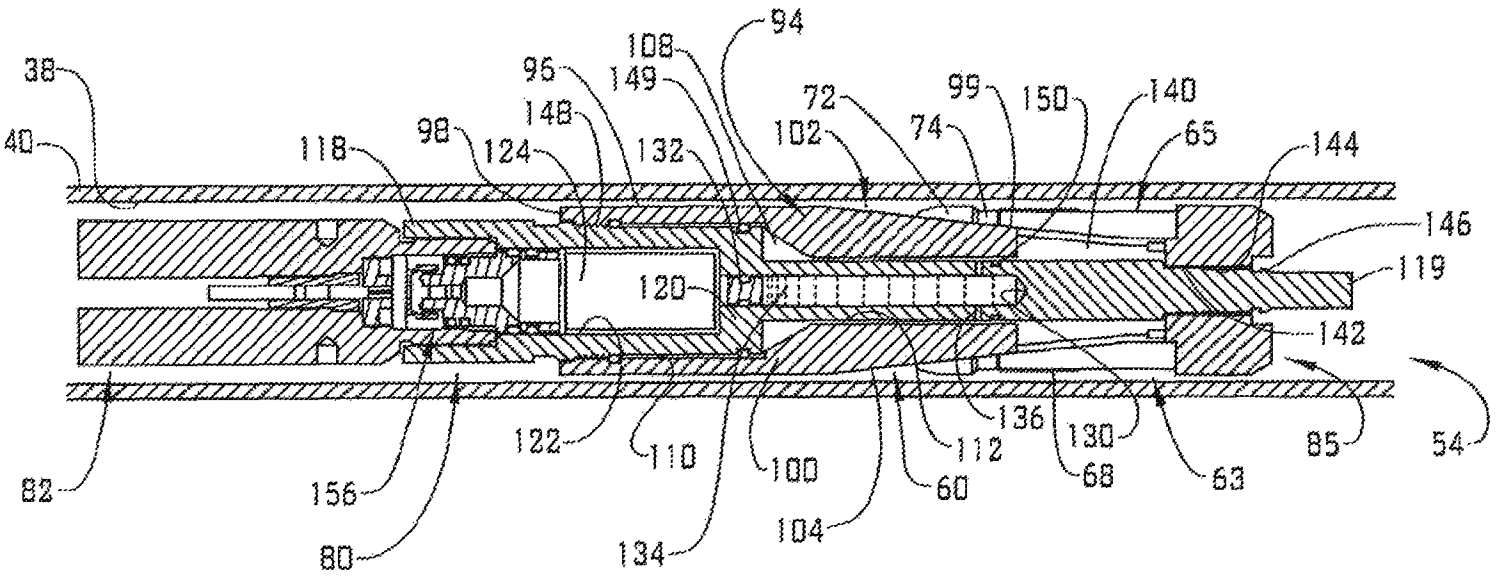
FIG. 3 depicts a cross-sectional view of the frac plug of FIG. 2, in accordance with an aspect of an exemplary embodiment.

Reference will now follow to FIG. 3, with continued reference to FIGS. 1 and 2 in describing frac plug system 54. Setting cone 60 includes a body 94 having an outer surface 96 including a first end 98, a second end 99, and an intermediate portion 100. A portion of body 94 includes a taper 102. In an embodiment, taper 102 defines a frusto-conical surface 104 that extends from second end 99 toward first end 98. A passage 108 extends through body 94. Passage 108 includes a first portion 110 having a first diameter and a second portion 112 having a second diameter that is smaller than the first diameter. Mandrel 80 extends through passage 108.

Mandrel 80 includes a first end portion 118, second end portion 119, and an intermediate section 120 extending therebetween. A conduit 122 extends through mandrel 80. A first portion (not separately labeled) of conduit 122 defines an actuation chamber 124 that, in the embodiment shown, is arranged in first portion 110 of passage 108. Actuation chamber 124 may take the form of a power charge chamber (not separately labeled) housing an amount of propellant which, when ignited, produces high pressure gases. Actuation chamber 124 may, in the alternative, house an atmospheric fluid, e.g., a fluid, such as air, at atmospheric pressure. Conduit 122 terminates at a blind end 130 within mandrel 80. A piston 132 is arranged in conduit 122 between actuation chamber 124 and blind end 130.

An amount of fluid 134 is disposed between piston 132 and blind end 130. The amount of fluid may take on many forms including hydraulic fluid, aqueous solutions, gas and the like. One or more openings 136 are arranged in conduit 122 between piston 132 and blind end 130. Openings 136 as sized so as to allow passage of fluid 134 upon movement of piston 132 toward blind end 130. Second end portion 119 extends through a central opening 140 provided in anchor 63 and a passage portion 142 provided in end cap 85. In one embodiment, second end portion 119 may be connected to end cap 85 through frangible threads 144. Second end portion 119 may include a stop member or travel limiter 146 that prevents end cap from pre-maturely disengaging from mandrel 80 during, for example, run in. Travel limiter 146 may take the form of an O-ring (not separately labeled).

A thread 148 provides a connection between setting cone 60 and mandrel 80 during a run-in operation. A first seal 149 is arranged between first end portion 118 and first portion 110 of passage 108. A second seal 150 extends about intermediate section 120 axially outwardly of openings 136 toward second end portion 119.

In an embodiment, frac plug system 54 may be run into wellbore 34 on wireline 30 to a desired position. Once in position, a signal may be sent to actuator head 82 from first system 14 to activate an actuator mechanism 156 arranged in first end portion 118 adjacent to actuation chamber 124. In an embodiment, actuator mechanism 156 ignites a power charge arranged in actuator chamber 124 creating a flow of high pressure gasses. In another embodiment, actuator mechanism 156 allows hydrostatic pressure to enter actuation chamber 124 creating a pressure differential with the atmospheric fluid. The flow of high pressure gases (or pressure differential between the hydrostatic fluid and the atmospheric fluid) act on piston 132 driving fluid 134 through openings 136. Fluid 134 flows toward first end portion 118. Movement of setting cone 60 causes threads 148 holding mandrel 80 in place to shear. Shearing the threads relative movement between setting cone 60 and mandrel 80 is now possible. At this point, it should be understood that in lieu of threads, mandrel 80 may be connected to setting cone 60 through shear screws (not shown). At this point, pressure induced by fluid 134 causes mandrel 80 to move axially relative to setting cone 60.

Figure 4:
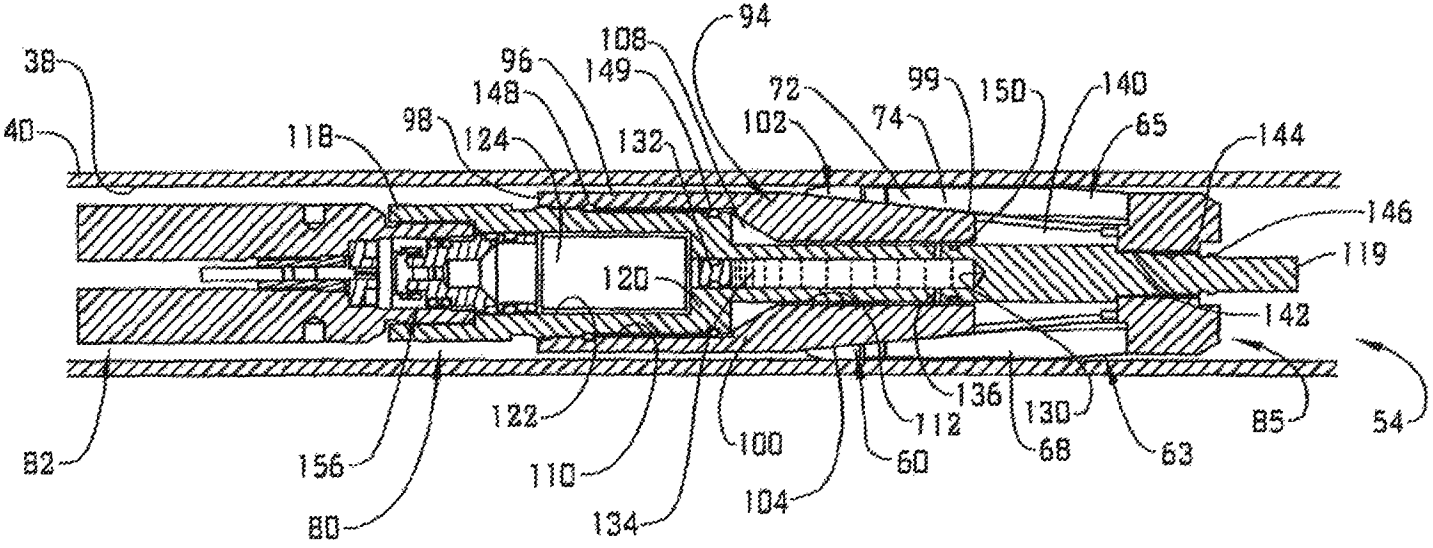
FIG. 4 depicts the frac plug of FIG. 3 being deployed such that an anchor and seal engage a casing wall, in accordance with an aspect of an exemplary embodiment.
Figure 5:
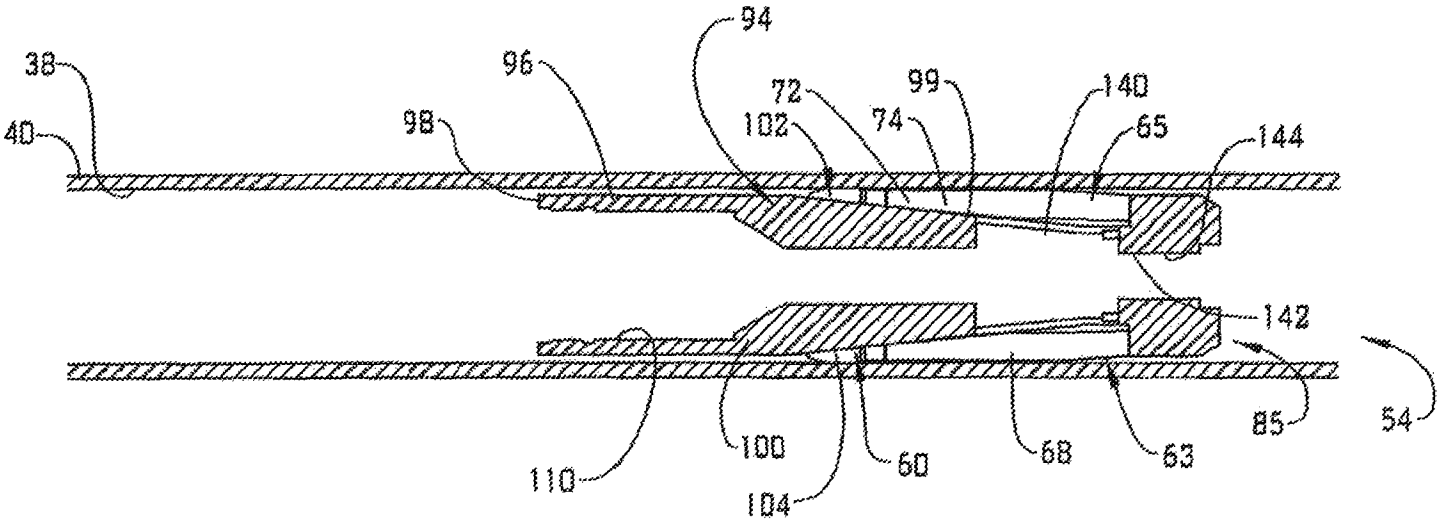
FIG. 5 depicts the frac plug of FIG. 4 after deployment.

Movement of end cap 85 is constrained causing anchor 63, backup ring 74 and seal 72 to move along frusto-conical surface 104. Anchor 63 moves along frusto-conical surface 104 until wickers 68 engage annular wall 38 preventing further movement as shown in FIG. 4. Seal 72 also engages annular wall 38. After anchor 63 is set, wireline 30 may be pulled upwardly toward first system 14 disengaging mandrel 80 from setting cone 60 as shown in FIG. 5. At this point, a signal may be sent to perforating guns (not shown) from first system 14 to activate explosive charges that create openings in casing 40. At this point, a plug (not shown) may be introduced into frac plug system 54 to fluidically isolate part of wellbore 34 from another. Surface system 16 may pump a fluid into wellbore 34 to initiate a fracturing operation. In an embodiment, setting cone 60, seal 72, backup ring 74 anchor 63 and end cap 85 may be formed from a dissolvable material. In this manner, frac plug system 54 may be removed after setting without the need for a milling operation or other procedure that requires additional trips into wellbore 34.

Figure 6:
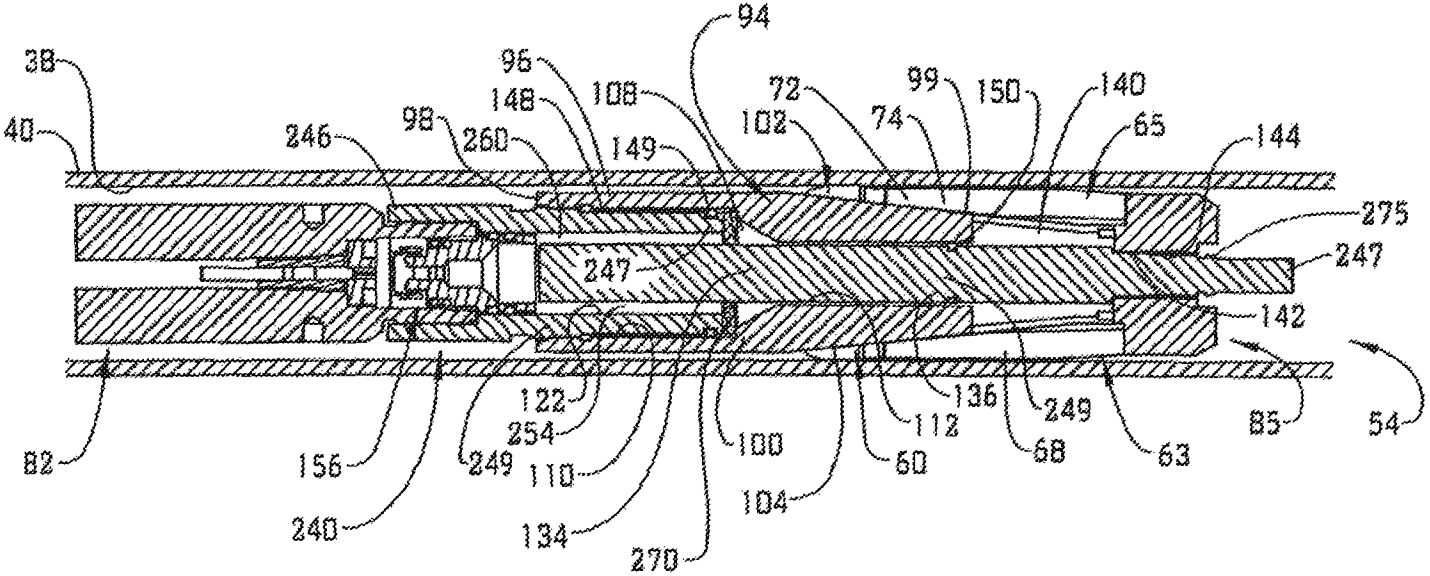
FIG. 6 depicts the frac plug of FIG. 1, in accordance with another aspect of an exemplary embodiment.

Reference will now follow to FIG. 6, wherein like reference numbers represent corresponding parts in the respective views, in describing a mandrel 240 in accordance with another aspect of an exemplary embodiment. Mandrel 240 extends through setting cone 60 and supports actuator head 82. Mandrel 240 also extends through an end cap 85. In the embodiment shown, mandrel 240 includes a first end portion 246, second end portion 247, and an intermediate section 249 extending therebetween. A conduit 254 extends through mandrel 240. A first portion (not separately labeled) of conduit 254 defines an actuation chamber 260. Actuation chamber 260 provides a pathway that connects actuator head 82 and a power charge 270.

In the embodiment shown, power charge 270 is arranged in passage 108 and extends around intermediate section 249 of mandrel 240. In a manner similar to that discussed herein, second end portion 247 may include a stop member or travel limiter 275 that prevents end cap from pre-maturely disengaging from mandrel 240 during, for example, run in. Travel limiter 275 may take the form of an O-ring (not separately labeled).

Once frac plug system 54 is in position, a signal may be sent to actuator head 82 from first system 14. Actuator head 82 than sends a signal to ignite power charge 270 creating a flow of high pressure gasses. The flow of high pressure act between setting cone 60 and mandrel 240. In this manner, relative movement between setting cone 60 and mandrel 240 may be effected causing a radial outward expansion of anchor 63.

The terms "about" and "substantially" are intended to include the degree of error associated with measurement of the particular quantity based upon the equipment available at the time of filing the application. For example, "about" and/or "substantially" can include a range of +8% or 5%, or 2% of a given value.

Set forth below are some embodiments of the foregoing disclosure:

Embodiment 1

A downhole tool comprising: a setting cone including a body having an outer surface having a first end, a second end and an intermediate portion, at least a portion of the body including a taper at the second end, a passage extends through the body from the first end to the second end, the passage including a first portion having a first diameter and a second portion having a second diameter that is less than the first diameter; an anchor arranged at the second end of the setting cone, the anchor including a central passage that aligns with the passage through the setting cone; and a mandrel extending through the passage of the setting cone and the central passage of the anchor, the mandrel including a first end portion, a second end portion and an intermediate section, a conduit extends from the first end portion toward the second end portion, a portion of the conduit defining a actuation chamber, an opening extends through the mandrel.

Embodiment 2

The downhole tool according to any previous embodiment, further comprising: a piston arranged in the conduit between the actuation chamber and the opening.

Embodiment 3

The downhole tool according to any previous embodiment, further comprising: a fluid arranged in the conduit between the piston and the opening.

Embodiment 4

The downhole tool according to any previous embodiment, further comprising a seal arranged between the first end portion of the mandrel and a surface of the first portion of the passage.

Embodiment 5

The downhole tool according to any previous embodiment, wherein one or more of the setting cone and the anchor is formed from a dissolvable material.

Embodiment 6

The downhole tool according to any previous embodiment, further comprising a cap member arranged at the anchor, the second end of the mandrel being connected to the cap member.

Embodiment 7

The downhole tool according to any previous embodiment, further comprising: an actuator head arranged at the first end portion of the mandrel adjacent the actuation chamber.

Embodiment 8

The downhole tool according to any previous embodiment, wherein the taper comprises a frusto-conical surface extending from the second end toward the first end.

Embodiment 9

The downhole tool according to any previous embodiment, further comprising: a seal arranged on the frusto-conical surface.

Embodiment 10

The downhole tool according to any previous embodiment, wherein the actuation chamber defines a power charge chamber housing an amount of propellant.

Embodiment 11

The downhole tool according to any previous embodiment, further comprising: a power charge arranged in the passage and extending about a portion of the intermediate portion of the mandrel.

Embodiment 12

The downhole tool according to any previous embodiment, an actuator head arranged at the first end portion of the mandrel in the actuation chamber.

Embodiment 13

The downhole tool according to any previous embodiment, wherein the conduit extends between the actuator head and the power charge.

Embodiment 14

A resource exploration and recovery system comprising: a first system; and a second system operatively connected to the first system through a wireline, the wireline supporting a downhole tool comprising: a setting cone including a body having an outer surface having a first end, a second end and an intermediate portion, at least a portion of the body including a taper at the second end, a passage extends through the body from the first end to the second end, the passage including a first portion having a first diameter and a second portion having a second diameter that is less than the first diameter; an anchor arranged at the second end of the setting cone, the anchor including a central passage that aligns with the passage through the setting cone; and a mandrel extending through the passage of the setting cone and the central passage of the anchor, the mandrel including a first end portion, a second end portion and an intermediate portion, a conduit extends from the first end portion toward the second end portion, a portion of the conduit defining an actuation chamber, an opening extends through the mandrel.

Embodiment 15

The resource exploration and recovery system according to any previous embodiment, further comprising: a piston arranged in the conduit between the actuation chamber and the opening.

Embodiment 16

The resource exploration and recovery system according to any previous embodiment, further comprising: a fluid arranged in the conduit between the piston and the opening, any previous embodiment Embodiment 17

The resource exploration and recovery system according to any previous embodiment, further comprising a seal arranged between the first end portion of the mandrel and a surface of the first portion of the passage.

Embodiment 18

The resource exploration and recovery system according to any previous embodiment, wherein one or more of the setting cone and the anchor is formed from a dissolvable material.

Embodiment 19

The resource exploration and recovery system according to any previous embodiment, further comprising a cap member arranged at the anchor, the second end of the mandrel being connected to the cap member.

Embodiment 20

The resource exploration and recovery system according to any previous embodiment, further comprising: an actuator head arranged at the first end portion of the mandrel adjacent the actuation chamber.

Embodiment 21

The resource exploration and recovery system according to any previous embodiment, wherein the taper comprises a frusto-conical surface extending from the second end toward the first end.

Embodiment 22

The resource exploration and recovery system according to any previous embodiment, further comprising: a seal arranged on the frusto-conical surface.

Embodiment 23

The resource exploration and recovery system according to any previous embodiment, wherein the actuation chamber defines a power charge chamber housing an amount of propellant.

Embodiment 24

The resource exploration and recovery system according to any previous embodiment, further comprising: a power charge arranged in the passage and extending about a portion of the intermediate portion of the mandrel.

Embodiment 25

The resource exploration and recovery system according to any previous embodiment, an actuator head arranged at the first end portion of the mandrel in the actuation chamber.

Embodiment 26

The resource exploration and recovery system according to any previous embodiment, wherein the conduit extends between the actuator head and the power charge.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The terms "about" and "substantially" are intended to include the degree of error associated with measurement of the particular quantity based upon the equipment available at the time of filing the application. For example, "about" and/or "substantially" can include a range of +8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole tool comprising:

a setting cone including a body having an outer surface having a first end, a second end and an intermediate portion, at least a portion of the body including a taper at the second end, a passage extends through the body from the first end to the second end, the passage including a first portion having a first diameter and a second portion having a second diameter that is less than the first diameter;

an anchor arranged at the second end of the setting cone, the anchor including a central passage that aligns with the passage through the setting cone; and a mandrel extending through the passage of the setting cone and the central passage of the anchor, the mandrel including a first end portion, a second end portion and an intermediate section, a conduit extends from the first end portion toward the second end portion, a portion of the conduit defining a actuation chamber, and an opening extends from the conduit through the mandrel, wherein pressure from the actuation chamber drives fluid through the opening into the passage causing the anchor to move along the taper of the setting cone.

2. The downhole tool according to claim 1, further comprising: a piston arranged in the conduit between the actuation chamber and the opening.

3. The downhole tool according to claim 2, further comprising: a fluid arranged in the conduit between the piston and the opening.

4. The downhole tool according to claim 1, further comprising a seal arranged between the first end portion of the mandrel and a surface of the first portion of the passage.

5. The downhole tool according to claim 1, wherein one or more of the setting cone and the anchor is formed from a dissolvable material.

6. The downhole tool according to claim 1, further comprising a cap member arranged at the anchor, the second end of the mandrel being connected to the cap member.

7. The downhole tool according to claim 1, further comprising: an actuator head arranged at the first end portion of the mandrel adjacent the actuation chamber.

8. The downhole tool according to claim 1, wherein the taper comprises a frusto-conical surface extending from the second end toward the first end.

9. The downhole tool according to claim 8, further comprising: a seal arranged on the frusto-conical surface.

10. The downhole tool according to claim 1, wherein the actuation chamber defines a power charge chamber housing an amount of propellant.

11. The downhole tool according to claim 1, further comprising: a power charge arranged in the passage and extending about a portion of the intermediate portion of the mandrel.

12. The downhole tool according to claim 11, an actuator head arranged at the first end portion of the mandrel in the actuation chamber.

13. The downhole tool according to claim 12, wherein the conduit extends between the actuator head and the power charge.

14. A resource exploration and recovery system comprising:

a first system; and a second system operatively connected to the first system through a wireline, the wireline supporting a downhole tool comprising:

a setting cone including a body having an outer surface having a first end, a second end and an intermediate portion, at least a portion of the body including a taper at the second end, a passage extends through the body from the first end to the second end, the passage including a first portion having a first diameter and a second portion having a second diameter that is less than the first diameter;

an anchor arranged at the second end of the setting cone, the anchor including a central passage that aligns with the passage through the setting cone; and a mandrel extending through the passage of the setting cone and the central passage of the anchor, the mandrel including a first end portion, a second end portion and an intermediate portion, a conduit extends from the first end portion toward the second end portion, a portion of the conduit defining an actuation chamber, and an opening extends from the conduit through the mandrel, wherein pressure from the actuation chamber passes through the opening into the passage causing the anchor to move along the taper of the setting cone.

15. The resource exploration and recovery system according to claim 14, further comprising: a piston arranged in the conduit between the actuation chamber and the opening.

16. The resource exploration and recovery system according to claim 15, further comprising: a fluid arranged in the conduit between the piston and the opening.

17. The resource exploration and recovery system according to claim 14, further comprising a seal arranged between the first end portion of the mandrel and a surface of the first portion of the passage.

18. The resource exploration and recovery system according to claim 17, wherein one or more of the setting cone and the anchor is formed from a dissolvable material.

19. The resource exploration and recovery system according to claim 14, further comprising a cap member arranged at the anchor, the second end of the mandrel being connected to the cap member.

20. The resource exploration and recovery system according to claim 14, further comprising: an actuator head arranged at the first end portion of the mandrel adjacent the actuation chamber.

21. The resource exploration and recovery system according to claim 14, wherein the taper comprises a frusto-conical surface extending from the second end toward the first end.

22. The resource exploration and recovery system according to claim 21, further comprising: a seal arranged on the frusto-conical surface.

23. The resource exploration and recovery system according to claim 14, wherein the actuation chamber defines a power charge chamber housing an amount of propellant.

24. The resource exploration and recovery system according to claim 14, further comprising: a power charge arranged in the passage and extending about a portion of the intermediate portion of the mandrel.

25. The resource exploration and recovery system according to claim 24, an actuator head arranged at the first end portion of the mandrel in the actuation chamber.

26. The resource exploration and recovery system according to claim 25, wherein the conduit extends between the actuator head and the power charge.

* * * * *